US011350700B2

(12) United States Patent
Smith et al.

(10) Patent No.: US 11,350,700 B2
(45) Date of Patent: Jun. 7, 2022

(54) SHOE WITH ADAPTIVE HEEL ELEMENT

(71) Applicant: adidas AG, Herzogenaurach (DE)

(72) Inventors: Paul Leonard Michael Smith, Nuremberg (DE); Stuart David Reinhardt, Portland, OR (US); Angus Wardlaw, Nuremberg (DE); Jan Hill, Großenseebach (DE); James Tarrier, Nuremberg (DE); Falk Bruns, Nuremberg (DE); Andreas Thieret, Herzogenaurach (DE); Oliver Wendel, Herzogenaurach (DE); Maximilian Grüttner, Herzogenaurach (DE); Bernhard Schuster, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 16/136,062

(22) Filed: Sep. 19, 2018

(65) Prior Publication Data

US 2019/0082789 A1 Mar. 21, 2019

(30) Foreign Application Priority Data

Sep. 20, 2017 (DE) ..... 10 2017 008 834.9

(51) Int. Cl.
*A43B 21/24* (2006.01)
*A43B 1/00* (2006.01)
(Continued)

(52) U.S. Cl.
CPC ..... *A43B 21/24* (2013.01); *A43B 1/0018* (2013.01); *A43B 1/04* (2013.01); *A43B 5/10* (2013.01);
(Continued)

(58) Field of Classification Search
CPC ..... A43B 21/24; A43B 23/024; A43B 1/04; A43B 23/0265; A43B 23/088; A43B 5/10;
(Continued)

(56) References Cited

U.S. PATENT DOCUMENTS 167,732 A * 9/1875 Blanchard ..... A41D 27/24 112/414
208,897 A * 10/1878 Emerson ..... A43B 23/02 36/47
(Continued)

FOREIGN PATENT DOCUMENTS

DE 618 718 A 9/1935
DE 618718 C 9/1935
(Continued)

OTHER PUBLICATIONS

European Search Report issued in European Patent Application No. 18195161.7, dated Feb. 12, 2019, 8 pages.

*Primary Examiner* — Khoa D Huynh
*Assistant Examiner* — Aiying Zhao
(74) *Attorney, Agent, or Firm* — Sterne, Kessler, Goldstein & Fox P.L.L.C.

(57) ABSTRACT

A shoe, in particular an athletic shoe, comprising a heel portion that includes an adaptive heel element arranged in the heel portion of the shoe, wherein the adaptive heel element comprises a stretch material. A heel counter is arranged in the heel portion, wherein the heel counter comprises a lateral portion and a medial portion for supporting the heel of a wearer's foot and a posterior gap therebetween wherein the posterior gap forms an essentially vertical split portion, wherein the split portion is adapted such that the adaptive heel element can move and deform within the split portion, and wherein the adaptive heel
(Continued)

element within the split portion is adapted to contour to the anatomical shape of the heel of the wearer.

20 Claims, 4 Drawing Sheets

(51) Int. Cl.

| | |
|---|---|
| ***A43B 7/1405*** | (2022.01) |
| ***A43B 5/10*** | (2006.01) |
| ***A43B 23/08*** | (2006.01) |
| ***A43B 23/02*** | (2006.01) |
| ***A43B 1/04*** | (2022.01) |

(52) U.S. Cl.
CPC ..... *A43B 7/141* (2013.01); *A43B 23/024* (2013.01); *A43B 23/0265* (2013.01); *A43B 23/088* (2013.01)

(58) Field of Classification Search
CPC ..... A43B 7/141; A43B 1/0018; A43B 23/28; A43B 23/08; A43B 7/14; A43B 5/00; A43B 23/045; A43B 23/047
USPC ..... 36/35 R, 68, 69, 51
See application file for complete search history.

(56) References Cited

U.S. PATENT DOCUMENTS

| | | | | |
|---|---|---|---|---|
| 236,323 | A * | 1/1881 | Graf | A43B 23/047 36/51 |
| 494,812 | A * | 4/1893 | Jonas | A43B 23/047 36/51 |
| 1,610,700 | A * | 12/1926 | Dudley | A43B 5/00 36/89 |
| 2,001,841 | A * | 5/1935 | Goth | A43C 11/002 36/51 |
| 4,451,996 | A | 6/1984 | Norton et al. | |
| 4,655,465 | A * | 4/1987 | Schaeffer | A43B 5/1691 280/11.12 |
| 7,637,032 | B2 * | 12/2009 | Sokolowski | A43B 23/0255 36/9 R |
| 2006/0283042 | A1 | 12/2006 | Greene et al. | |
| 2011/0099848 | A1 | 5/2011 | Tomat et al. | |
| 2014/0259780 | A1 * | 9/2014 | Labonte | A43B 5/1691 36/102 |
| 2014/0283410 | A1 | 9/2014 | Marvin et al. | |
| 2015/0047255 | A1 | 2/2015 | Casdorph | |
| 2015/0143716 | A1 * | 5/2015 | Long | A43B 1/04 36/83 |
| 2017/0196309 | A1 | 7/2017 | Ferguson | |
| 2017/0311672 | A1 * | 11/2017 | Hipp | A43B 3/0031 |

FOREIGN PATENT DOCUMENTS

| | | | |
|---|---|---|---|
| DE | 26 06 800 | A1 | 8/1977 |
| DE | 4329594 | A1 | 3/1995 |
| DE | 43 29 594 | A1 | 9/1995 |
| DE | 201 19 907 | U1 | 4/2003 |
| DE | 102013202 353 | A1 | 8/2014 |
| DE | 10 2015 224 885 | A1 | 6/2017 |
| DE | 102016 201 973 | A1 | 8/2017 |
| DE | 102016201973 | A1 | 8/2017 |
| EP | 2 316 292 | A1 | 5/2011 |
| FR | 2341282 | A1 | 9/1977 |
| JP | S056671 | Y | 6/1930 |
| JP | 49-9433 | U | 1/1974 |
| JP | 1974009433 | U | 1/1974 |
| JP | S52-20342 | U | 2/1977 |
| JP | 3052628 | U | 7/1998 |
| JP | 2011-92724 | A | 5/2011 |
| JP | 2011092724 | A | 5/2011 |
| JP | 2011-160898 | A | 8/2011 |
| JP | 2016-86993 | A | 6/2016 |

* cited by examiner

SHOE WITH ADAPTIVE HEEL ELEMENT

TECHNICAL FIELD

The present invention relates to a shoe, in particular an athletic shoe, having a heel portion and a heel counter, comprising an adaptive heel element.

TECHNICAL BACKGROUND

In the art of shoe manufacturing and in particular, in the design of high performance athletic shoes a strong demand exists for improving the heel construction of said shoes.

For instance, it is desired to enhance the fit of the shoe in the heel region, while at the same time to increase comfort, performance and/or perception as well as manufacturability. In this context, a variety of heel constructions are well known in the prior art, as for example in prior art documents U.S. Pat. No. 7,168,188 B2, U.S. Pat. No. 6,023,857 A, JP 04,69,9464 B2 and U.S. Pat. No. 9,232,831 B2.

U.S. Pat. No. 7,168,188 B2 discloses an article of footwear comprising among other components a heel counter secured to the upper and a heel pad removably attached to the inner surface of the heel counter.

U.S. Pat. No. 6,023,857A relates to a shoe with removable midsole, wherein among other features the midsole includes a heel counter extending upwardly from a portion of the rearward end of the midsole, wherein the heel counter being adapted for cradling the shoe wearer's heel and wherein the midsole and the heel counter being integral with each other.

JP 04,69,9464 B2 relates to an article of footwear that includes a sole assembly and an upper secured to the sole assembly, wherein a heel counter is secured to the sole assembly and includes an inner portion and an outer portion that is secured to the inner portion, wherein a portion is captured between the inner and the outer portion of the heel counter.

U.S. Pat. No. 9,232,831B2 discloses a heel counter structure for a shoe that includes among other features a sole plate provided at least at the heel region of the shoe and having a peripheral portion that is upraised along the heel region of the shoe.

However, the heel constructions disclosed in the prior art have various disadvantages. For example, the heel counter may be difficult to integrate into the shoe, the fit of the shoe in the heel region may be insufficient and/or the heel portion may exert undesired pressure and friction onto the heel and in particular the Achilles tendon of the foot of the wearer during activities such as walking or running. Additionally, some of the heel portions may be costly and cumbersome to manufacture.

It is therefore an object of the present invention to further improve the heel construction of a shoe in order to at least partly overcome one or more of the above-mentioned disadvantages of the prior art, so as to improve the fit, wearing comfort and manufacturing of the shoe.

SUMMARY OF THE INVENTION

The above-mentioned problem is at least partly solved by the subject matters of the claims of the present application. In one embodiment, the present invention provides a shoe, in particular an athletic shoe comprising a heel portion, an adaptive heel element arranged in the heel portion of the shoe, wherein the adaptive heel element comprises a stretch material, a heel counter arranged in the heel portion, wherein the heel counter comprises a lateral portion and a medial portion for supporting the heel of a wearer's foot and a posterior gap therebetween, wherein the posterior gap forms an essentially vertical split portion, wherein the split portion is adapted such, that the adaptive heel element can move and deform within the split portion and wherein the adaptive heel element within the split portion is adapted to contour to the anatomical shape of the heel of the wearer.

For example, if the shoe is designed for sports such as running and/or jogging, this embodiment ensures to achieve movement freedom of the Achilles tendon in the sagittal, frontal and transversal plane, while improving the heel lock when wearing the shoe (i.e. limiting the relative movement between the heel of the foot and the inner surface of the heel portion during running or jogging).

In a further embodiment, the heel counter is arranged on the outside of the heel portion of the shoe.

For example, this embodiment allows for a simple manufacturing of the heel portion of the shoe, since the heel counter does not need to be integrated within another component of the heel portion but can be attached externally.

In a further embodiment of the invention, the top end of the vertical split portion has a width in between 20 mm and 30 mm, more preferably in between 28 mm and 22 mm and most preferably in between 27 mm and 23 mm whereas the bottom end of the vertical split portion has a width in between 15 mm and 25 mm, more preferably in between 17 mm and 23 mm and most preferably in between 18 mm and 22 mm.

For example, said parameter ranges correspond to a broad range of anatomical shapes of the heel region of a foot of different wearers and thereby ensure that the adaptive heel element can exactly contour to the anatomical shape of heel region irrespective of anatomical differences among different wearers of the shoe.

In a further embodiment of the invention, the adaptive heel element exhibits an S-shape when projected to the sagittal plane of the shoe.

Said S-shape ensures that the adaptive heel element provides a tight heel lock and at the same time that the pressure and thereby the friction onto the Achilles tendon of the foot of the wearer is significantly reduced during running or jogging. Thus, this embodiment reduces the risk for developing blisters and/or lesions during wearing the shoe.

In a further embodiment of the invention, the adaptive heel element forms a U-shaped profile along the longitudinal extension of the adaptive heel element.

Said U-shape profile ensures that the adaptive heel element comprising the stretch material, tightly fits the anatomical shape of the Achilles tendon of the wearer without exerting undesired pressure and correspondingly friction while wearing the shoe, thereby further reducing the risk for developing blisters and/or lesions.

In a further embodiment of the invention, the adaptive heel element is folded onto itself to form a dual-layer material, comprising an outer layer and an inner layer. Moreover, the adaptive heel element may comprise a cut-out in the outer layer of the stretch material, wherein the cut-out is stitched together along the edge of the cut-out. In further embodiments, the cut-out in the outer layer of the adaptive heel element may have an elliptical shape or an eye shape and may be arranged in the upper half or upper third of the adaptive heel element. In other examples, the cut-out shape could have another shape so that its width extension is larger than its height dimension.

Said embodiments provide a simple and efficient way of implementing the above-mentioned S-shape of the adaptive heel element and therefore may result in a faster, more controllable and less costly manufacturability during mass production as well as increased longevity of the adaptive heel element and/or the complete shoe.

In a further embodiment of the invention, the adaptive heel element comprises a layer of reinforcement material, wherein the layer of reinforcement material may be arranged in between the inner and the outer layer of the adaptive heel element.

For example, said embodiment further enhances the mechanical and/or structural properties of the adaptive heel element, thereby contributing to improving the structural rigidity and longevity of the shoe.

In a further embodiment of the invention, the lateral and the medial portions of the heel counter are connected via at a least a joining element or are integrally formed.

For example, this embodiment may reduce the number of manufacturing steps and improve the structural properties of the heel counter.

In a further embodiment of the invention, the adaptive heel element comprises at least a portion of a foamed material that is arranged in between the inner and the outer layer of the adaptive heel element.

For example, this embodiment may enhance the cushioning properties of the adaptive heel element, thereby further enhancing the heel fit and further reducing undesired pressure and/or friction exerted on the heel region of a wearer's foot while wearing the shoe.

In a further embodiment of the invention, the lateral and medial edges of the adaptive heel element are joined with the edges of the lateral and medial sections of the upper of the shoe, wherein the lateral and medial edges of the adaptive heel element may be joined by stitching seams with the lateral and the medial sections of the upper of the shoe.

For example, this embodiment allows for a fast and simple integration of the adaptive heel element with the remaining sections of the upper of the shoe during manufacturing—potentially reducing costs and duration of manufacturing the shoe.

In a further embodiment, the joining edges between the lateral and medial sections of the upper of the shoe and the adaptive heel element are at least in part covered by the heel counter.

For example, this embodiment enhances the structural integrity of the shoe, by reducing the potential stress that is directly affecting the joining edges between the adaptive heel element the lateral and medial sections of the upper of the shoe, resulting in increased longevity of the shoe.

In a further embodiment of the invention, the stretch material of the adaptive heel element comprises a 2-way stretch material that in particular may comprise a 2-way stretch circular knit sandwich mesh. In other embodiments of the invention the stretch material of the adaptive heel element may comprise a 4-way stretch material.

In particular, the stretch material may exhibit a stretch under a load of 100N (Newtons) in longitudinal direction in between 75% and 130%, preferably in between 85% and 120% and most preferably in between 95% and 115%. Further, the stretch material may exhibit a stretch under a load of 100N in cross direction in between 60% and 130%, preferably in between 75% and 120% and most preferably in between 85% and 105%. Further, the stretch material may exhibit an areal density in between 300 g/m^2 and 700 g/m^2, preferably between 400 g/m^2 and 600 g/m^2, more preferably between 450 g/m^2 and 550 g/m^2 and most preferably in between 475 g/m^2 and 525 g/m^2.

For example, said parameter ranges may provide the adaptive heel element with the necessary deformability that enables the adaptive heel element to contour the varying anatomic shapes of the heel region of different wearers.

As an example, a shoe of the present invention may be an athletic shoe such as a high performance running shoe, an (indoor) football boot, a basketball boot, a tennis shoe or similar.

A further aspect of the invention provides a method for manufacturing a shoe, an athletic shoe, the method comprising the steps of providing a heel portion, providing an adaptive heel element arranged in the heel portion of the shoe, wherein the adaptive heel element comprises a stretch material, arranging a heel counter in the heel portion, wherein the heel counter comprises a lateral portion and a medial portion for supporting the heel of a wearer's foot and a posterior gap therebetween, wherein the posterior gap forms an essentially vertical split portion, wherein the split portion is adapted such, that the adaptive heel element can move and deform within the split portion, and providing the adaptive heel element such that it is adapted to contour to the anatomical shape of the heel of the wearer.

BRIEF DESCRIPTION OF THE FIGURES

Aspects of the present invention are described in more detail in the following by reference to the accompanying figures. These figures show.

DETAILED DESCRIPTION

In the following, exemplary embodiments of the present invention of a shoe with a heel portion are described in more detail with reference to a shoe such as an athletic shoe. However, it is to be understood that the present invention is not limited to specific shoes but could be applied to other types of shoes, for instance high performance running shoes, (indoor) football boots, basketball boots, tennis shoes or similar.

Moreover, while specific feature combinations are described in the following with respect to certain embodiments of the present invention, it is to be understood that the disclosure is not limited to such embodiments. In other words, not all features have to be present for realizing the invention and the embodiments may be modified by combining certain features of one embodiments with one or more features of another embodiment.

Figure 1:
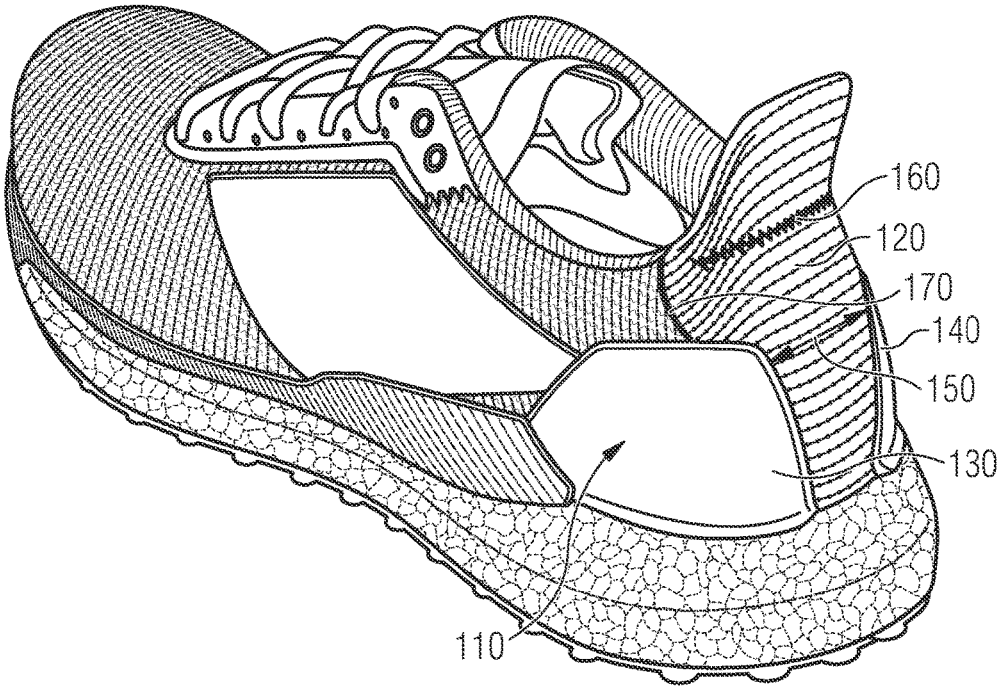
FIG. 1: a lateral-posterior view of an athletic shoe according to an embodiment of the present invention.

FIG. 1 shows a lateral-posterior view of a shoe according to an embodiment of the present invention. Among other components as for example a sole assembly the shoe comprises a heel section 110 that in turn comprises an adaptive heel element 120 comprising a stretch material such as a 4-way stretch material and/or a 2 way stretch material. Preferably, the stretch material is a 2-way stretch circular knit sandwich mesh and/or any other stretch material or combination of materials exhibiting significant stretching and/deformation properties. The heel section 110 may further comprise a heel counter, which in the embodiment depicted in FIG. 1 is implemented as a split external heel counter comprising a lateral portion 130 and a medial portion 140 that may be arranged on and/or attached to the outside of the heel portion 110. The heel counter is forming an essentially vertical split portion 150 (essentially vertical meaning that the vertical extension of the split section is larger than its horizontal extension) that at least partially uncovers the underlying adaptive heel element 120 of the heel portion 110. This allows to support the heel of a wearer's foot while at the same time ensures that the Achilles tendon and the adjacent tissue and skin of the wearer's foot is not subjected to undesired pressure induced by the material of the heel counter, that may be significantly stiffer than the stretch material of the adaptive heel element 120 of the heel portion 110 of the shoe. For example, the heel counter may comprise any known polymer with the required mechanical performance and rigidity which is used in the art, for example, polyamide, thermoplastic polyurethane, polycarbonate or similar. The lateral portion 130 and medial portion 140 of the heel counter may be implemented as distinct parts that exhibit no direct connection with each other (i.e. the essentially vertical split portion 150 extends along the complete longitudinal extension of the heel counter in direction of the Achilles tendon of the wearer). The lateral 130 and the medial portion 140 of the heel counter may also be connected by at least a joining element or may also be integrally formed. This may be advantageous to manufacture the heel counter. In such configurations, the vertical split portion 150 may only extend along a fraction of the longitudinal extension of the heel counter or may be interrupted by one or several joining elements. The contouring portion 120 of the heel portion of the shoe may be directly connected with a lateral and medial section (not shown in FIG. 1) of the upper of the shoe. For instance, the edges 170 between the adaptive heel element and the lateral and medial sections of the upper may be joined via stitching seams or any other suitable means for joining the components of an upper of a shoe, as it is well known in the art.

Figure 2:
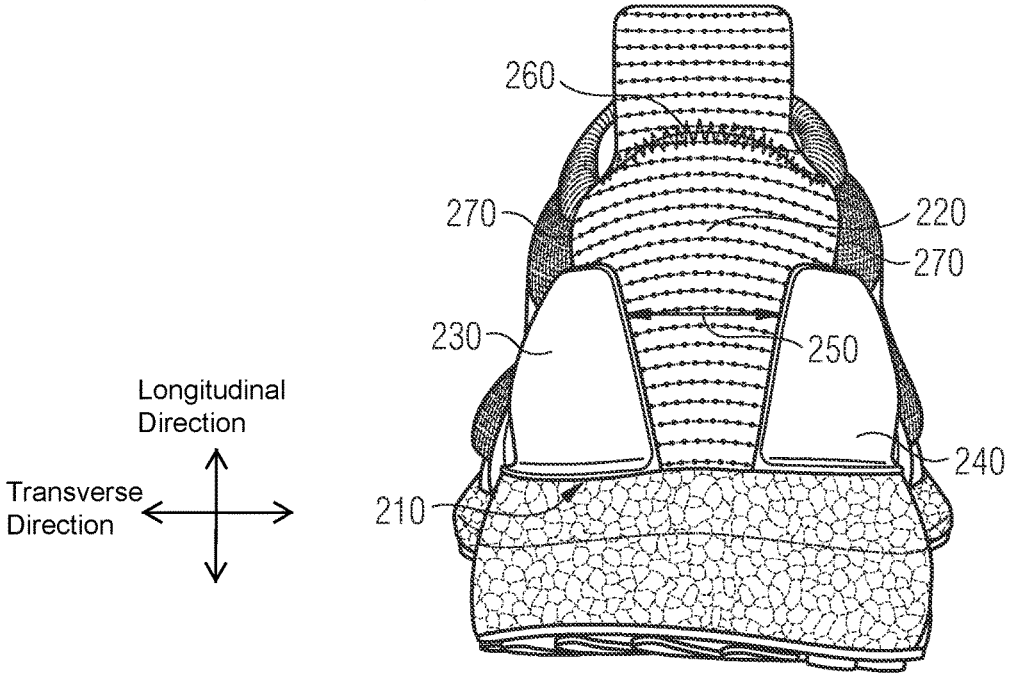
FIG. 2: a posterior view of an athletic shoe according to an embodiment of the present invention.

FIG. 2 shows a posterior view of a shoe according to an embodiment of the present invention. In accordance with the description of FIG. 1 above, the heel section 210 of the shoe may comprise an adaptive heel element 220 comprising a stretch material such as a 4-way stretch material and/or a 2 way stretch material and in particular a 2-way stretch circular knit sandwich mesh and/or any other stretch material or combination of materials exhibiting significant stretching and/deformation properties. The heel section 210 may further comprise a heel counter, which may be implemented as an external split heel counter comprising a lateral portion 230 and a medial portion 240 that may be arranged on and/or attached to the outside of the heel portion 210. In another example, the lateral and medial portions may also be covered, for instance by a lining or other material. The heel counter forms an essentially vertical split portion 250 that at least partially uncovers the underlying adaptive heel element 220 of the heel portion 210 in the region of a wearer's foot, where usually the Achilles tendon of the foot is located.

It is preferred that the horizontal dimensions of the split (indicated by the arrow 250 in FIG. 2) can vary between 15 mm and 30 mm. The width of the split need not be constant. For instance, it could be narrower at the bottom (close to the sole) and wider at the top portion of the heel counter, as illustrated for example by FIG. 2. As an example, the narrowest part could be 15 mm and the widest part could be 30 mm. Other dimensions are also conceivable, such as 20 mm at the bottom and 25 mm near the top. In this way, the split may resemble a trapezoidal shape. However, the skilled person will understand that the shape and/or dimensions of the split also depend on the size of the shoe.

This construction of the heel counter allows to support the heel of a wearer's foot while at the same time ensuring that the Achilles tendon and the adjacent tissue and skin of the wearers foot is not subjected to undesired pressure induced by the material of the heel counter, that may be significantly stiffer than the stretch material of the adaptive heel element 220 of the heel portion 210 of the shoe.

In the example of FIG. 2, the lateral portion 230 and medial portion 240 of the heel counter are implemented as distinct parts that exhibit no direct connection with each other (i.e. the essentially vertical split portion 250 extends along the complete longitudinal extension of the heel counter in direction of the Achilles tendon of the wearer). However, the lateral 230 and the medial portion 240 of the heel counter may also be connected by at least one joining element or may also be integrally formed as a joint component. In such configurations, the vertical split portion 250 may only extend along a fraction of the longitudinal extension of the heel counter or may be interrupted by one or several joining elements.

Moreover, the adaptive heel element 220 may comprise an outer layer that is directed to the outside of the shoe and an inner layer that is directed towards the foot of the wearer. Said dual-layer structure may be formed by folding the stretch material onto itself, wherein the fold may be located at the upper edge of the adaptive heel element 220. The adaptive heel element 220 that may comprise a dual-layer structure as described above, may further comprise a cut-out 260 in the outer layer of the adaptive heel element. The adaptive heel element 220 may be stitched together along the edge of the cut-out 260 such that the adaptive heel element 220 is pulled away from the Achilles tendon of the wearer's foot thereby forming a S-shape when the adaptive heel element 220 is viewed projected onto the sagittal plane of the shoe.

In an example, the stitched cut-out 260 may be arranged in the upper half of the adaptive heel element 220 or even the upper third of the adaptive heel element 220. Other configurations may be conceivable where the cut-out may be arranged differently or at different locations on the adaptive heel element 220. In addition, the stitched together seam of the cut-out 260 may exhibit an arch like form, with the apex of the arch being directed towards the top edge of the adaptive heel element 220. This configuration may further enhance the shape and the strain distribution of the adaptive heel element in order to reduce the pressure and friction that may be exerted onto the heel region and/or the Achilles tendon of the heel of a wearer's foot.

The adaptive heel element 220 of the heel portion of the shoe may be connected with a lateral and medial section (not shown in FIG. 2) of the upper of the shoe, wherein the edges 270 between the adaptive heel element 220 and the lateral and medial sections of the upper of the shoe may be joined via stitching seams (e.g., flat stitches or zig-zag stitches) or by any other suitable means known in the art for joining the components of an upper of a shoe (such as gluing or cementing).

The joining seams 270 between the adaptive heel element 220 and the lateral and medial section of the upper of the shoe may further be at least partially covered by the lateral 230 and medial portions 240 of the external heel counter.

Figure 3:
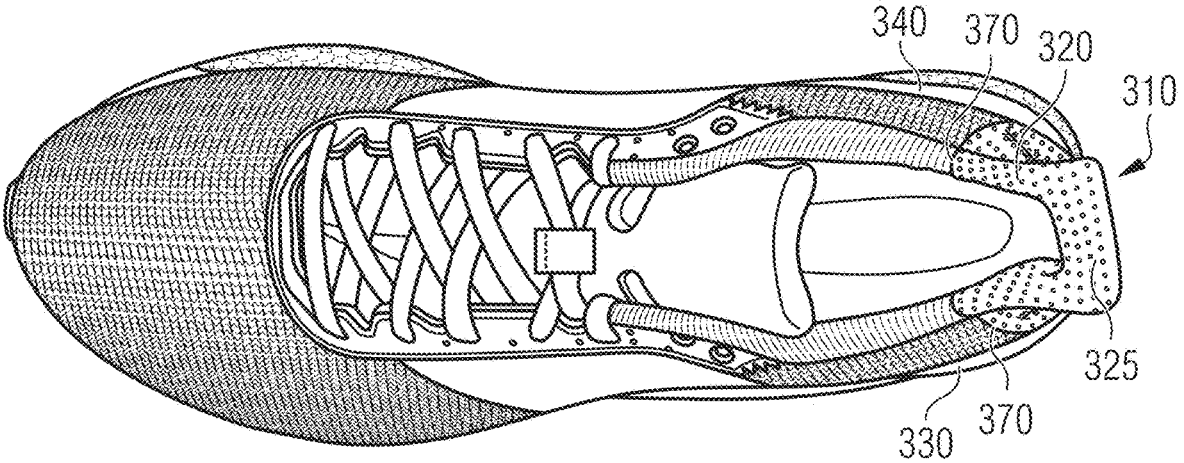
FIG. 3: a top view of an athletic shoe according to an embodiment of the present invention.

FIG. 3 shows a top view of a shoe according to an embodiment of the present invention. In addition to the features that have been already described with reference to FIG. 1 and FIG. 2 above, FIG. 3 further illustrates that the adaptive heel element 320 of the heel portion 310 of the shoe, forms a U-shaped profile 325 that extends along the longitudinal direction (i.e. in direction of the Achilles tendon of the wearer's foot) of the adaptive heel element 320 of the heel portion. Said U-shaped profile 325 in combination with the stretching properties of the stretch material that is comprised by the adaptive heel element 320, enables the adaptive heel element 320 to adapt closely to the anatomical shape of the heel region of the wearer's foot in general and the anatomical shape of the Achilles tendon in particular, while wearing the shoe during walking, running and/or jogging or other activities. In addition, FIG. 3 again illustrates the position of the lateral 330 and medial 340 portions of the external heel counter as well as the joining seams 370 between the adaptive heel element 320 and the lateral and medial sections of the upper of the shoe.

Figure 4:
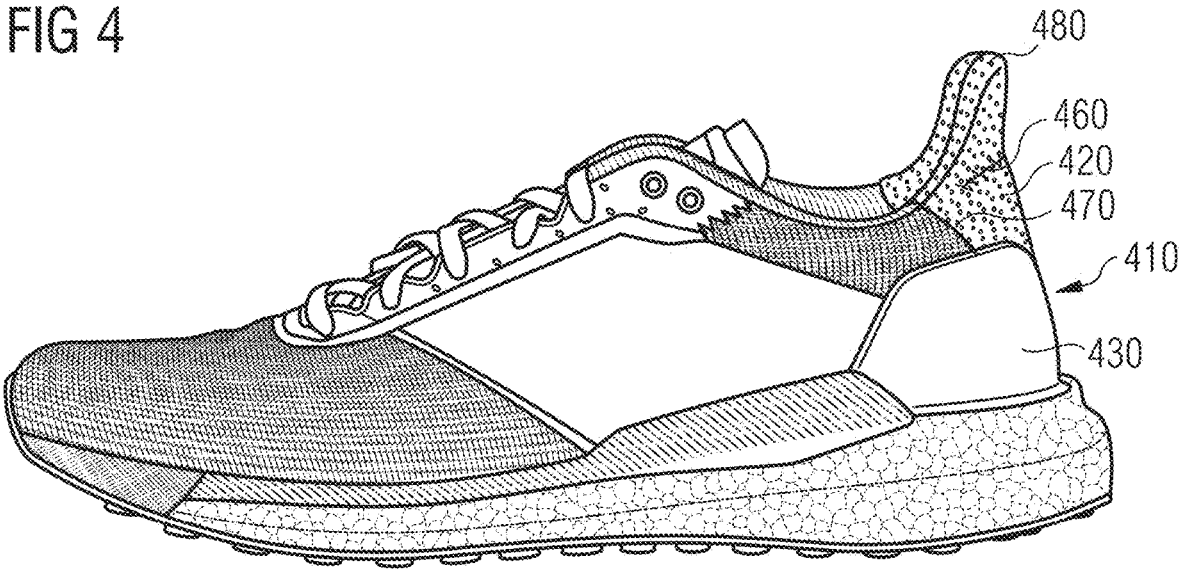
FIG. 4: a medial view of an athletic shoe according to an embodiment of the present invention.

FIG. 4 depicts a medial view of an athletic shoe according to an embodiment of the present invention. In accordance with the preceding illustrations, the heel section 410 of the shoe comprises an adaptive heel element 420 that is arranged at the posterior end of the shoe, an external heel counter comprising a medial portion 430 and a lateral portion 440 (not shown). In addition, FIG. 4 illustrates the cut-out 460 that is stitched together along the edge of the cut-out 460, the joining seams 470 between the adaptive heel element 420 and the medial section of the upper of the shoe as well as the fold 480 located at the top of the adaptive heel element 420 (also referred to as heel counter tab), along which the stretch material has been folded onto itself to form the dual-layer material of the adaptive heel element 420. The particular design of the adaptive heel element 420 comprising the dual-layer stretch material and the elliptical stitched together cut-out 460 significantly simplifies the manufacturing of the adaptive heel element 420 while ensuring that it exhibits the above-mentioned S-shape as required for ensuring a tight heel lock and simultaneously reduced pressure and/or friction exerted onto the heel region and/or the Achilles tendon of the wearer's foot.

Figure 5A:
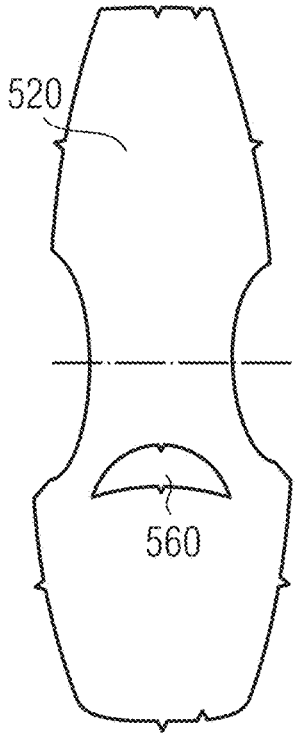
FIG. 5*a*-5*c*: a construction schematic of an adaptive heel element of a shoe according to an embodiment of the present invention.
Figure 5B:
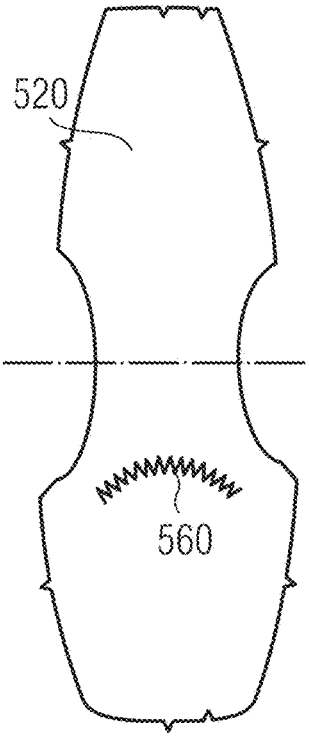
Figure 5C:
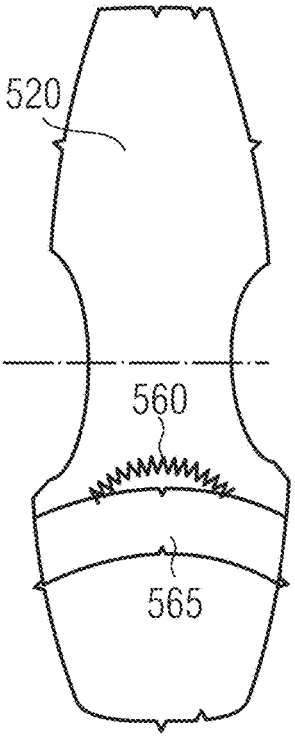

FIGS. 5*a*-5*c* depict construction schematics of the adaptive heel element 520 of an athletic shoe according to an embodiment of the present invention. The dashed line in the center of FIGS. 5*a*-5*c* shows the position of the fold where the stretch material of the adaptive heel element 520 is folded onto itself to form the dual-layer material. This position corresponds to the fold 480 in FIG. 4 above. In FIG. 5*a* the elliptical or eye-shaped cut-out 560 in the outer layer of the stretch material is depicted. FIG. 5*b* illustrates the adaptive heel element 520 after the cut-out 560 has been stitched together along the edge of the cut-out 560, wherein the stitching seam exhibits an arch-like form with the apex of the arch being directed toward the fold of the stretch material. FIG. 5*c* shows the adaptive heel element 520 after a strip of the reinforcement material 565 has been attached to the adaptive heel element 520 by a suitable means for attaching the strip such as gluing, sewing or similar. The strip of reinforcement material 665 may comprise the same material and/or material of similar stretching properties and/or material exhibiting different stretching and material properties as the stretch material of the adaptive heel element 520.

Figure 6A:
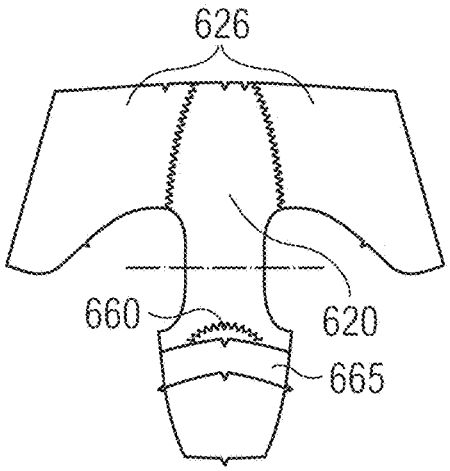
FIG. 6*a*-6*b*: a construction schematic of a heel portion of a shoe according to an embodiment of the present invention.
Figure 6B:
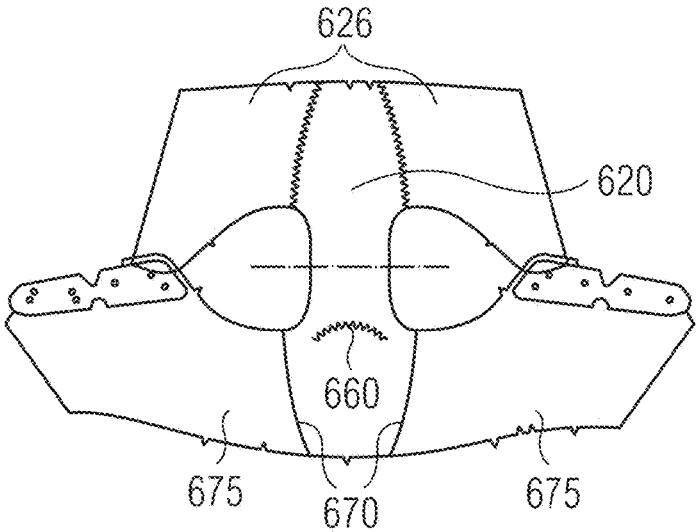

FIGS. 6*a*-6*b* illustrates how the adaptive heel element 520 of FIGS. 5*a*-5*c* is further processed and integrated into the upper of the shoe during manufacturing. FIG. 6*a* depicts the adaptive heel element 620 after the cut-out 660 has been stitched together with an arch-like seam and after the strip of reinforcement material 665 has been attached to the adaptive heel element 620. As before, the dashed line indicates the position of the fold along which the stretch material is folded onto itself to form the dual-layer material. In addition, two further sheets of material 626 have been joined with the inner layer of the stretch material along two additional stitching seams. The additional sheet of material 262 may comprise the same stretch material as the adaptive heel element 620 and/or a different material and/or a combination of the stretch material and/or different materials. FIG. 6*b* shows a construction schematic of the heel portion of the shoe prior to folding the stretch material onto itself (again, the position of the fold is indicated by the dashed line) and prior to attaching the lateral and medial portions (not shown) of the external heel counter to the outside of the heel portion of the shoe. In addition to the components and features shown in FIG. 6*a*, FIG. 6*b* also illustrates portions of the lateral and medial sections 675 of the upper of the shoe that are joined with the adaptive heel element 620 by gluing, stitching, for example, via flat lock stitching or zig-zag stitching or any other joining means known in the art of shoe construction. It should be noted, that in FIG. 6*b* the adaptive heel element 620 has been flipped, such that the strip of reinforcing material 665 is hidden behind the adaptive heel element 620.

In the following, an embodiment of a manufacturing method for a shoe according to the present invention is described in further detail with reference to FIGS. 5*a*-5*c*, FIGS. 6*a*-6*b*, FIGS. 7*a*-7*b* and FIG. 8. In a first step, an adaptive heel element 520 comprising a stretch material is provided. The stretch material can be any 2-way or 4-way stretch material suited for the manufacturing of shoe components in general or components of athletic shoes in particular. Examples include 2-way stretch circular knit sandwich mesh or similar materials. In a next step, an elliptical or eye-shaped cut-out 560 is produced below the fold line of the adaptive heel element 520, wherein the fold line is indicated by the dashed line. The shape of the cut-out may be also of different shape, like rectangular, circular, trapezoidal or any other suitable shape that results in a similar S-shape of the adaptive heel element 520 after assembly as described above. The position of the cut-out 560 is arranged such that after folding the cut-out 560 is in the upper half or upper third of the folded adaptive heel element 520, wherein the top edge of the adaptive heel element 520 is defined by the position of the fold line. The section of the adaptive heel element below the fold line that is containing the cut-out 560 may constitute the outer layer of the adaptive heel element 520 in the finale shoe assembly. After the cut-out 560 has been produced by appropriate means such as cutting, die-cutting or similar, the cut-out 560 is sewn together along the edge of the cut-out as shown in FIG. 5*b*. The shape of the joining seam of the cut-out 560 may be arch-like, wherein the apex of the arch is directed toward the fold line and thus directed towards the top of the adaptive heel element in the final shoe assembly. The edge of the cut-out 560 may also be joined together by other means such as gluing, edge melting or similar. FIG. 5*c* illustrates a further optional manufacturing step comprising attaching a strip of reinforcement material 565 slightly below the joined edges of the cut-out 560, wherein the strip 565 exhibits an arch-like form with the apex oriented towards the fold line as it may be also the case for the joined edge of the cut-out 560. The strip of reinforcing material may be attached to the surface of the adaptive heel element via means such as gluing, stitching melting or any other means suitable for attaching a strip of material to the stretch material of the adaptive heel element 520. When the adaptive heel element 520, 620 has been prepared as shown in FIG. 5 or similar, the adaptive heel element 520, 620 may be further connected to two additional sheets of material 626 via two additional joining seams as depicted in FIG. 6*a*. These seams may be joined via stitching or different joining methods as described above. In a next step of the manufacturing method the adaptive heel element 520 that in this stage may also comprise the two additional sheets of material 626 may be joined together with lateral and medial sections 675 of the upper of the shoe. The joining edges that connect the adaptive heel element 620 to the lateral and medial sections of the upper of the shoe may be joined by sewing, edge malting or similar as described above and known in the art. Note that in FIG. 6*b* the strip of reinforcing material is not visible since it is located on the other surface of the shown assembly.

Figure 7A:
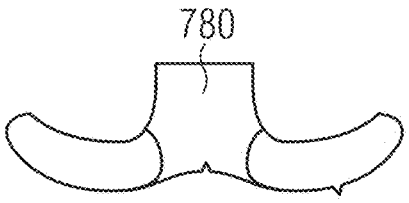
FIG. 7*a*-7*b*: a construction schematic of a heel portion of a shoe according to an embodiment of the present invention.
Figure 7B:
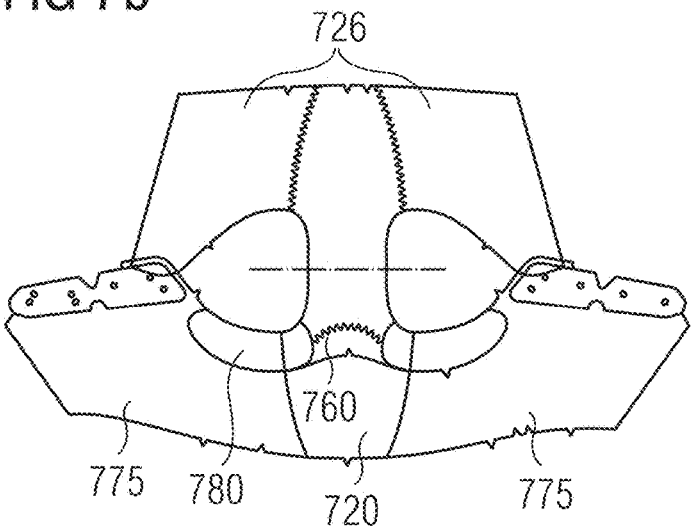

As illustrated in FIG. 7*a* in a next manufacturing step, a further component 780 of the heel section, wherein the component 780 comprises a foamed material is attached to the assembly shown in FIG. 6*a*. A preferred shape of the foamed component 780 is illustrated in FIG. 7*a*. Said shape is adapted to provide cushioning at the desired region of the heel of the wearer's foot and in particular in the region of the Achilles tendon of the foot. The foamed material of the foamed component 780 may be any foamed material that is known in the art of shoe construction and exhibits the required cushioning properties. FIG. 7*b* illustrated the position where the foamed part 780 may be attached to the assembly containing the adaptive heel element 720 during manufacturing of the heel portion of the shoe. It should be noted, that the foamed component 780 is attached to the backside of the assembly depicted in FIG. 7*b* (i.e. on the side of the assembly that is facing inside the plane of FIG. 7*b*). As the cut-out 760 and the facultative strip of reinforcement material (not shown in FIG. 7*b*) the foamed component 780 is attached below the fold line again indicated by the dashed line. This has the effect that the center section of foamed component will be sandwiched in between the outer and inner layer of the adaptive heel element 720 after folding, wherein the outer sections of the foamed component 780 will be sandwiched in between the two additional sheets of material 726 and the lateral and medial section 775 of the upper of the shoe after folding the assembly shown in FIG. 7*b* along the fold line.

Figure 8:
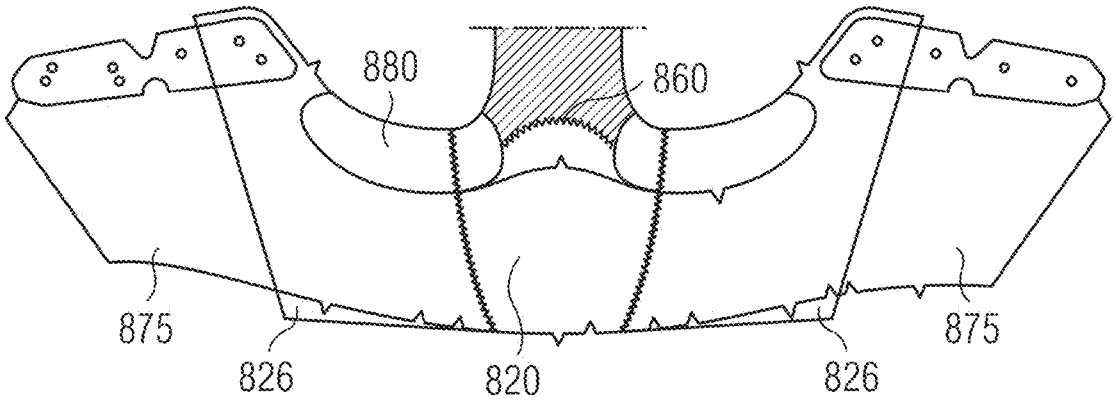
FIG. 8: a construction schematic of a heel portion of a shoe according to an embodiment of the present invention.

FIG. 8 depicts the assembly of FIG. 7*b* comprising the same components as in FIG. 7*b* after the assembly has been folded along the dashed fold line.

Further manufacturing steps comprise arranging and attaching a heel counter on the outside of and/or within the heel portion. In some examples, the heel counter may comprise a lateral portion and a medial portion for supporting the heel of a wearer's foot as well as a posterior gap therebetween, wherein the posterior gap may form an essentially vertical split portion, that may be configured such, that the adaptive heel element 820 can move and deform within the split portion and wherein the adaptive heel element within the split portion is adapted to contour to the anatomical shape of the heel of the wearer.

What is claimed is:

1. A shoe, comprising:

a heel portion, an adaptive heel element arranged in the heel portion of the shoe, wherein the adaptive heel element comprises a stretch material; and a heel counter arranged in the heel portion, wherein the heel counter comprises a lateral portion and a medial portion for supporting the heel of a wearer's foot and a posterior gap therebetween, wherein the posterior gap forms a vertical split portion, wherein the split portion is adapted such that the adaptive heel element can move and deform within the split portion, wherein the adaptive heel element comprises an outer layer that includes the stretch material, and an inner layer, wherein the outer layer comprises a cut-out having an edge that is stitched together such that the edge is joined directly to itself, wherein a portion of the adaptive heel element is pulled rearwards from an interior of the shoe by the stitched-together cut-out, and wherein the adaptive heel element is adapted to contour to the anatomical shape of the heel of the wearer.

2. The shoe according to claim 1, wherein the adaptive heel element is configured to contour to the anatomical shape of the Achilles tendon of the wearer.

3. The shoe according to claim 1, wherein the top end of the vertical split portion has a width in between 20 mm and 30 mm, and wherein the bottom end of the vertical split portion has a width in between 15 mm and 25 mm.

4. The shoe according to claim 1, wherein the adaptive heel element forms a U-shaped profile along a longitudinal extension of the adaptive heel element.

5. The shoe according to claim 1, wherein the adaptive heel element is folded onto itself to form a dual-layer material, comprising the outer layer and an inner layer.

6. The shoe according claim 1, wherein the cut-out is arranged in an upper half of the adaptive heel element.

7. The shoe according to claim 5, wherein the adaptive heel element comprises a layer of reinforcement material, wherein the layer of reinforcement material is arranged in between the inner layer and the outer layer of the adaptive heel element.

8. The shoe according to claim 1, wherein the lateral and the medial portions of the heel counter are connected via at least a joining element or are integrally formed.

9. The shoe according to claim 5, wherein the adaptive heel element comprises at least a portion of a foamed material that is arranged in between the inner layer and the outer layer of the adaptive heel element.

10. The shoe according to claim 1, wherein lateral and medial edges of the adaptive heel element are joined with edges of the lateral and medial sections of an upper of the shoe.

11. The shoe according to claim 10, wherein the joining between the lateral and medial sections of the upper and the adaptive heel element is at least in part covered by the heel counter.

12. The shoe according to claim 1, wherein the stretch material comprises a 2-way stretch material.

13. The shoe according to claim 1, wherein the stretch material comprises a 2-way stretch circular knit sandwich mesh.

14. The shoe according to claim 1, wherein the stretch material comprises a 4-way stretch material.

15. The shoe according to claim 1, wherein the stretch material exhibits a stretch under a load of approximately 100 Newton, N, in longitudinal direction between 75% and 130%.

16. The shoe according to claim 1, wherein the stretch material exhibits a stretch under a load of approximately 100 N in transverse direction of between 60% and 130%.

17. The shoe according to claim 1, wherein the stretch material exhibits an areal density between 300 g/m^2 and 700 g/m^2.

18. A shoe comprising a heel counter according to claim 1.

19. A method for manufacturing a shoe, the method comprising the steps of:

providing a heel portion;

forming a cut-out in a stretch material;

stitching an edge of the cut-out directly together to close the cut-out;

forming an adaptive heel element arranged in the heel portion of the shoe by folding the stretch material to form an outer layer and an inner layer of the stretch material, wherein the stitched-together cut-out is in the outer layer of the adaptive heel element, wherein the stitched closed cut-out shapes the adaptive heel element by causing a portion of the adaptive heel element to be pulled rearwards from an interior of the shoe; and arranging a heel counter in the heel portion, wherein the heel counter comprises a lateral portion and a medial portion for supporting the heel of a wearer's foot and a posterior gap therebetween, wherein the posterior gap forms an essentially vertical split portion, wherein the split portion is adapted such that the adaptive heel element can move and deform within the split portion.

20. A shoe, comprising:

a heel portion, an adaptive heel element arranged in the heel portion of the shoe, wherein the adaptive heel element comprises a stretch material; and a heel counter arranged in the heel portion, wherein the heel counter comprises a lateral portion and a medial portion for supporting the heel of a wearer's foot and a posterior gap therebetween that defines a split portion of the heel portion, wherein the adaptive heel element is folded onto itself to form a dual-layer material, comprising an outer layer and an inner layer, wherein the outer layer of the adaptive heel element includes the stretch material, wherein the outer layer further comprises a cut-out having an edge that is stitched directly together to close the cut-out such that a top portion of the adaptive heel element is pulled rearwards from an interior of the shoe, wherein the cut-out is arranged in the upper half of the adaptive heel element, wherein the split portion is adapted such that the adaptive heel element can move and deform within the split portion, and wherein the adaptive heel element is adapted to contour to the anatomical shape of the heel of the wearer.

* * * * *